US007277080B2

(12) United States Patent
Goulthorpe

(10) Patent No.: US 7,277,080 B2
(45) Date of Patent: Oct. 2, 2007

(54) THREE DIMENSIONAL DYNAMIC DISPLAY SYSTEM

(76) Inventor: Mark Goulthorpe, 4 Elm Rd., Great Stuckeley Huntingdon Cambridgeshire (GB) PE17 5AU ( * ) Notice: Subject to any disclaimer, the term of this patent is extended or adjusted under 35 U.S.C. 154(b) by 155 days.

(21) Appl. No.: 10/297,771

(22) PCT Filed: Jun. 15, 2001

(86) PCT No.: PCT/GB01/02630

§ 371 (c)(1),
(2), (4) Date: Sep. 11, 2003

(87) PCT Pub. No.: WO01/97202

PCT Pub. Date: Dec. 20, 2001

(65) Prior Publication Data

US 2004/0051704 A1 Mar. 18, 2004

(30) Foreign Application Priority Data

Jun. 15, 2000 (GB) ..... 0014669.6

(51) Int. Cl.
*G09G 3/34* (2006.01)
*G09F 9/37* (2006.01)

(52) U.S. Cl. ..... 345/108; 40/446

(58) Field of Classification Search ..... 345/156, 345/173; 40/446, 564; 91/363 R; 425/175
See application file for complete search history.

(56) References Cited

U.S. PATENT DOCUMENTS 2,115,533 A * 4/1938 Myers ..... 40/423
3,018,683 A * 1/1962 Way ..... 84/464 R
3,961,837 A 6/1976 Bied-Charreton et al.
4,087,810 A 5/1978 Hung et al.
4,878,417 A * 11/1989 Facon ..... 91/363 R
4,909,611 A 3/1990 Spooner
5,388,992 A * 2/1995 Franklin et al. ..... 434/114
5,717,423 A * 2/1998 Parker ..... 345/156
5,851,563 A * 12/1998 Hoffman ..... 425/175
5,943,801 A * 8/1999 Wilkinson ..... 40/564
6,189,246 B1 * 2/2001 Gorthala ..... 40/446
6,337,678 B1 * 1/2002 Fish ..... 345/156
6,535,201 B1 * 3/2003 Cooper et al. ..... 345/173

FOREIGN PATENT DOCUMENTS

| | | |
|---|---|---|
| GB | 1 397 168 | 9/1973 |
| GB | 1 573 846 | 3/1977 |
| GB | 1 538 359 | 5/1977 |
| GB | 2 303 650 | 2/1997 |
| WO | 99/10863 | 3/1999 |

* cited by examiner

*Primary Examiner*—Amr A. Awad
*Assistant Examiner*—William Lee Boddie
(74) *Attorney, Agent, or Firm*—Renner, Otto, Boisselle & Sklar, LLP

(57) ABSTRACT

The display system comprises a screen (1) made of an array of metal triangular facets (30) which are driven in and out by an array of pneumatic pistons (2) located behind the screen (1). The rear ends of the pistons (2) are flexibly connected by damped pivots (8) to a structural frame (7). The front ends of the pistons (2) are flexibly coupled to connection nodes between the facets (30) by connection devices (10) which have legs (13) which may splay apart as the pistons are pushed forwards. The pistons (2) may therefore be used to give the screen (1) of the facets (30) a visible 3-dimensional surface effect such as a sinusoidal deformation (101). The display system also includes an electronic control system for driving the pistons (2). The electronic control system may use a stored data file to produce a particular surface effect on the screen (1). Alternatively, the control system may respond in real-time to an input such as ambient sound, ambient lighting conditions or the like.

22 Claims, 13 Drawing Sheets

THREE DIMENSIONAL DYNAMIC DISPLAY SYSTEM

The present invention relates to a display system, to display apparatus therefor and to a control system therefor.

Various small-scale display devices are known. GB-1, 573,846 discloses a display device in which an elastic membrane is locally deformed electrostatically at image points to display and hold an image. Similar display devices are disclosed in GB-1,538,359 and in U.S. Pat. No. 4,909, 611. The display device of GB-1,397,168 uses electromagnetism to deflect its membrane at the image points. All of these display devices are small scale and do not produce forwards and backwards motion of the membrane that is easily directly visible to the naked eye. Also, the membranes are not suited to the vigorous movement needed to display directly-visible dynamic images which involve repeated sharp localized bending of the membrane to produce a high-contrast contoured image of the membrane itself.

According to a first aspect of the present invention, there is provided display apparatus as defined in Claim 1. Preferred features are recited in Claims 2 to 20.

The display apparatus may for example be installed on or in a building, so that it forms a wall or else a skin on a wall. It could be located inside the building, outside the building or partially inside and partially outside the building. For example, it could be installed partially in a reception area and then penetrate out of the atrium of the reception area onto an outside wall of the building.

Although the display surface (display screen) will mainly be used to display dynamic images, it may be used to hold static images. For example, an advertisement advertising a particular play inside a theatre could be statically displayed on the screen for a period of time, and then the display apparatus could switch from static mode to dynamic mode to display surface effects showing moving pictures taken from the play.

The surface effect to be produced may be based on prerecorded information, or else the desired image could be determined by ambient conditions. For example, the ambient sound could be used to produce ripples or abstract patterns which increase in intensity in terms of the depth of movement and/or the speed of sweeping across the screen as the level of the ambient sound increases. It might also be arranged for the screen image to be in response to detecting people passing by in the vicinity. For example, the screen could suddenly spring into life and display a greeting message.

Currently, the preferred mechanical actuators are pneumatic pistons, which may be controlled by electromagnetic solenoid valves. As any form of mechanical driver would be suitable to be used as an actuator, alternatives to pneumatic pistons would include electric step-servo systems and hydraulic pistons. In general, what is required is a mechanical actuator which produces a mechanical output which may be used to move the display surface in and out Thus, the mechanical actuator may itself be powered in any way, including pneumatically, hydraulically or electrically.

It may be desirable to illuminate the screen with an oblique light source in order to help to make more visible the undulations of the 3-dimensional surface effect.

In a preferred embodiment, the present invention provides a rapidly reconfigurable display surface which may be used to generate patterns thereon, by the real time calculation of mathematical equations.

The screen is in effect a flexible surface or skin. In most applications, it will need to be robust, yet supple. We currently prefer to use a facetted surface which limits the elasticity primarily to the connections between rigid facets.

A suitable refresh rate for the screen could be, for example, 10 frames per second, or more preferably 100 frames per second.

Whilst a personal computer could be used to control the actuators, it may be preferable to use an embedded system. This should have the advantage that, if there is a power failure, nothing of value would be lost from the embedded system and it would automatically resume where it left off when the power is eventually returned.

The skin surface of the screen is, in our prototype, made of polished material so as to reflect the light. It may be possible to select the material so that it appears to change colour with viewing angle when the screen surface is moved in use relative to a viewer. This should enable the display apparatus to appear to produce coloured surface effects or images.

According to a second aspect of the present invention, there is provided a control system for controlling display apparatus, as recited in Claim 21. Preferred aspects of the control system are recited in Claims 22 to 26.

The third aspect of the present invention comprises a display system combining together the display apparatus of the first aspect of the invention and the control system of the second aspect of the invention.

A fourth aspect of the present invention provides a method for controlling a display apparatus, as recited in Claim 28. A preferred aspect of the method is recited in Claim 29.

The present invention also provides a computer program product as recited in Claim 30, and a computer usable storage medium having the computer program product stored thereon, as recited in Claim 31.

A. General Discussion of the First Prototype

A.1 Main Points

The first prototype is capable of producing rapid yet accurate physical deformation of an elasticated surface at large (architectural) scale. It links a physical display apparatus with an electronic control system. The physical display apparatus comprises a matrix of actuators (of variable number and density) linked to an elastic surface capable of rapid expansion and contraction to permit supple and continuous movement of the surface in three dimensions. The electronic control system comprises a mathematical modeller which generates positional data and feeds it via a bus system to the actuators using a programme control unit (PCU).

The overall effect of the first prototype is that of a three-dimensional screen, the actuators being similar to the pixels on a television set but capable of 3-dimensional positioning in space. Its speed and refresh rate are faster than a television set, enabling sequences of moving images as well as mathematical patterns to be played across the surface. It can be made responsive to any electronic input such that it can respond interactively to a wide variety of stimuli, from weather conditions to the movement of people or ambient sounds. It may also respond to prerecorded inputs such as recorded music or recorded images such as sequences of patterns or advertising. Potential applications include entertainment and communication uses and acoustical damping.

A.2 Technical Description

The physical display apparatus will now be described separately from the Electronic Control System, although they work together.

A.2.1 The Physical Display Apparatus

This comprises the following elements:

1. a structural framework of aluminium or steel, which holds
2. a grid of electronic, pneumatic or hydraulic actuators (pistons) together with
3. any ancillary valves, pipes, cables, compressors, etc These can be of varying size or density. The actuators are pivoted about their bases to allow the actuator shafts to rotate, the pivots being damped to absorb impact. This is achieved by:

4. a synthetic rubber sleeve attached to the frame and threaded to take the piston shaft This could also be achieved by a rotating ball socket or similar damping device.

The head of the piston is supported by 5. a series of metal springs or rubber/synthetic elastic strips that attach to the frame and offer a damping to the rotation of the piston about its base.

The head of the piston shaft is attached to an elasticated surface which comprises:

6. rigid or semi-rigid facets (which may be of any material, eg 2 mm aluminium sheet)
7. connection devices ('squids') which transmit the movement of the pistons to the skin and which link the facets together as a surface whilst permitting them to move freely in three dimensions
8. intermediate connection devices (pistonless 'squids') which link the facets of the surface between adjacent pistons (such that the density of the actuators may be varied in relation to the density of the facets)

The connection devices (squids) are secured to the actuators by:

9. a rigid sleeve cast into the connection device fastened mechanically to the shaft of the actuator The facets are secured to the connection devices (squids) by:

10. a rigid sleeve glued or welded to the back of the facet, which is crimped over the end of
11. a rigid stud which is embedded/fused/fixed to the connection device (squid).

A.2.2 The Electronic Control System

The electronic control system controls the physical display apparatus, feeding it with positional information and so effectively controlling the movement patterns of the surface. It combines several functional aspects, and allows for variants of increased complexity and sophistication:

A.2.2.1 Electronic Sensors as Input Devices

A series of electronic sensors are used to trigger the device, the signals being obtained from the detection of movement, light, sound, or even from remote computers (e.g. files sent by e-mail) or video devices, giving a changing input signal. The effect of this will be to allow external stimuli to be registered in the movement of the device, creating the possibility of an 'interactive' movement potential. A sharp noise, for instance, might lead to an increased velocity of wave-forms.

In principle this could involve any device which is able to generate an electronic signal, but in practice it is envisaged that proprietary electronic monitoring devices will be used such as burglar movement detectors, thermostats, etc, linked to a standard building control system. The input signal will be evaluated by a program which will determine how it is to be used, outputting a command to the Mathematical Generator (see below).

A.2.2.2 Simulator/Active Generator

This comprises a program especially written in C++ or other language installed on a standard PC which is created to simulate the movement potential of the physical display apparatus. This will be shown as a visual image on a computer screen, and be capable of alteration of all basic functional parameters to simulate the physical display apparatus in operation when subject to different parameters and input commands. For instance, the simulator will be able to show the difference between the operating system at 3.5 bar with 600 mm pistons of 12 mm diameter and at 7 bar with 500 mm pistons of 20 mm diameter. This will require that the simulator calculates at high speed and makes allowance for the rendering time of a computer screen.

This program not only serves as a simulator, but can be used as an active generator of movement, where the computer keyboard and mouse serve to trigger effects in the same manner as input from the Electronic Sensors, ie movement of the mouse may be used to generate movement in the display surface, such that the device may be 'played' like a synthesiser keyboard.

Initially Borland's C++ Builder v1.0, 1997, standard edition, is being used but in principle such programming can be done with any version It uses STL and OpenGL, but could use Direct X 3D or any other suitable programme.

A.2.2.3 Mathematical Generator/Programmatic Base

The signals from the Electronic Sensors or the Simulator are processed by a Mathematical Generator which is a program especially written which evaluates mathematical functions. The input signal is used to select a particular function or combination of functions, and also to vary the parameters of those functions. The program is written in C++ or any other language, and operates using a Linux operating system or simply DOS to reduce Opsys 'slug'. Alternatively it could be downloaded to an embedded network of Scenix microchips, operating outside of any operating system. The PC has both a sound card adapter and a video input adapter to connect to a video cameras The data extracted from these will be used to modify the parameters of the Mathematical Generator, perhaps using stereo effects to detect the position of people in space.

A.2.2.4 Program Control Unit/Bus System

This requires a file of positional data to be generated (0.01 sec is taken as a typical speed, but could be varied), which is then transmitted via a bus system to the actuators, which are simultaneously refreshed at the chosen speed. The file will contain the piston identification (ID) and the number of relative steps to move (either +n or −n) or the absolute position to move to or the time of valve opening. Two bytes will define the piston and one byte the position. Initially I am assuming that for every frame of 0.01 sec all piston positions will be given, and that a file will be generated with a start byte ID and a byte for every piston giving position. In this the first position byte is for Piston 1 and the last byte for Piston X, where X=the number of pistons in the Physical Display Apparatus (which can vary).

The file has error checking i.e. cyclic redundancy checking (CRC) to ensure the positions are valid. No action by the physical display apparatus is allowed until the data is checked.

A.2.3 Variants

Positional Monitoring

I can envisage more complex versions which would incorporate varying degrees of positional monitoring, giving greater accuracy to the display apparatus. Such positional registration could be achieved using a variety of devices such as magnetic reed switches or solenoid coils or simply a physical wheel-and-cog device attached to each piston. The positional data from these devices would feed back into the program control unit, which would constantly scan the data and make adjustments accordingly.

The effective difference of this would be that the control system is not devised on the basis of timed air supply, but as a series of direct positional commands, ie each piston is simply told to go to a certain position and when it reaches it the air supply is stopped. Evidently this increases the amount of data transfer considerably and would necessitate a greatly expanded control system.

Size and Density

The size and density of the physical display apparatus may be altered, as well as the throw of the pistons, such that a wide variety of different applications may be envisaged.

Elasticated Surface Configuration

Effectively I have devised a surface which combines rigid facets with elastic connection devices which work to spread the load of the actuators across the surface. One can imagine a wide variety of different configurations for this (the facets could be square or hexagonal, for instance).

The facets can also be thought of as being flexible, the limit-ase of this being a surface which is simply an elasticated sheet where the connection devices effectively fuse with the surface. In the description above the surface is elasticated by its structural capacity to open and close, and this principle may be increased or reduced to achieve a variety of degrees of elasticity appropriate to the size and spacing of the actuators.

A.2.4 Description of Operation

The display system operates through a combination of the Physical Display Apparatus and the Electronic Control System as follows:

1. The electronic sensors or the simulator generate an impulse which inputs to the mathematical generator.
2. This signal is interpreted by the mathematical generator program and it launches a particular sequence of calculations which it evaluates as frames of positional data giving the position of every actuator (piston) in space.
3. This information is loaded onto a bus system (generally at intervals of 0.01 sec) where it triggers the actuators (pistons).
4. In the case where the actuators are pneumatic, the solenoid valves are connected to a manifold which is pressured by a compressor. As the solenoid valves are triggered so air is released to the pistons for a certain length of time which displaces the pistons to differing positions in space.
5. As the actuator launches it creates differential movement in the surface which creates force in the connection and damping devices. Since they are elastic they deform to share the load between them in the most efficient manner:
   a. the connection device ('squid') legs open or close to allow the facets to separate or close together
   b. the connection device ('squid') body bends to even out the stress in the legs
   c. the piston rotates about its base neoprene gasket, forced to move by the deforming body of the squid
   d. the springs which hold the head of the piston stretch differentially to accommodate this new position.
6. The control program will systematically check the mathematical patterns generated to ensure that it operates within certain performance criteria (so as not to overstress the skin).
7. In the case where there is a positional monitoring system, there will be constant feed-back of positional data to compare the actual position of the pistons at any time with their ideal position, and the system will make adjustments accordingly.

A.2.5 Effect of the Display System

The dynamically reconfigurable surface is able to create a wide variety of 3-dimensional surface effects limited only by the physical parameters of any particular configuration of the display apparatus. A display apparatus with actuators spaced at 50 cm will evidently give less defined patterns than a display apparatus with actuators spaced at 25 cm, and an actuator with a throw of 25 cm will give different effects than an actuator with a throw of 50 cm.

The speed of effects is limited by the refresh rate; if the display apparatus is fed information every 0.01 sec then adjacent pistons can be triggered at intervals of 0.01 sec, allowing 100 pistons to be triggered in 1 second.

B. MORE DETAILED DISCUSSION OF THE FIRST PROTOTYPE

Figures 1, 2:
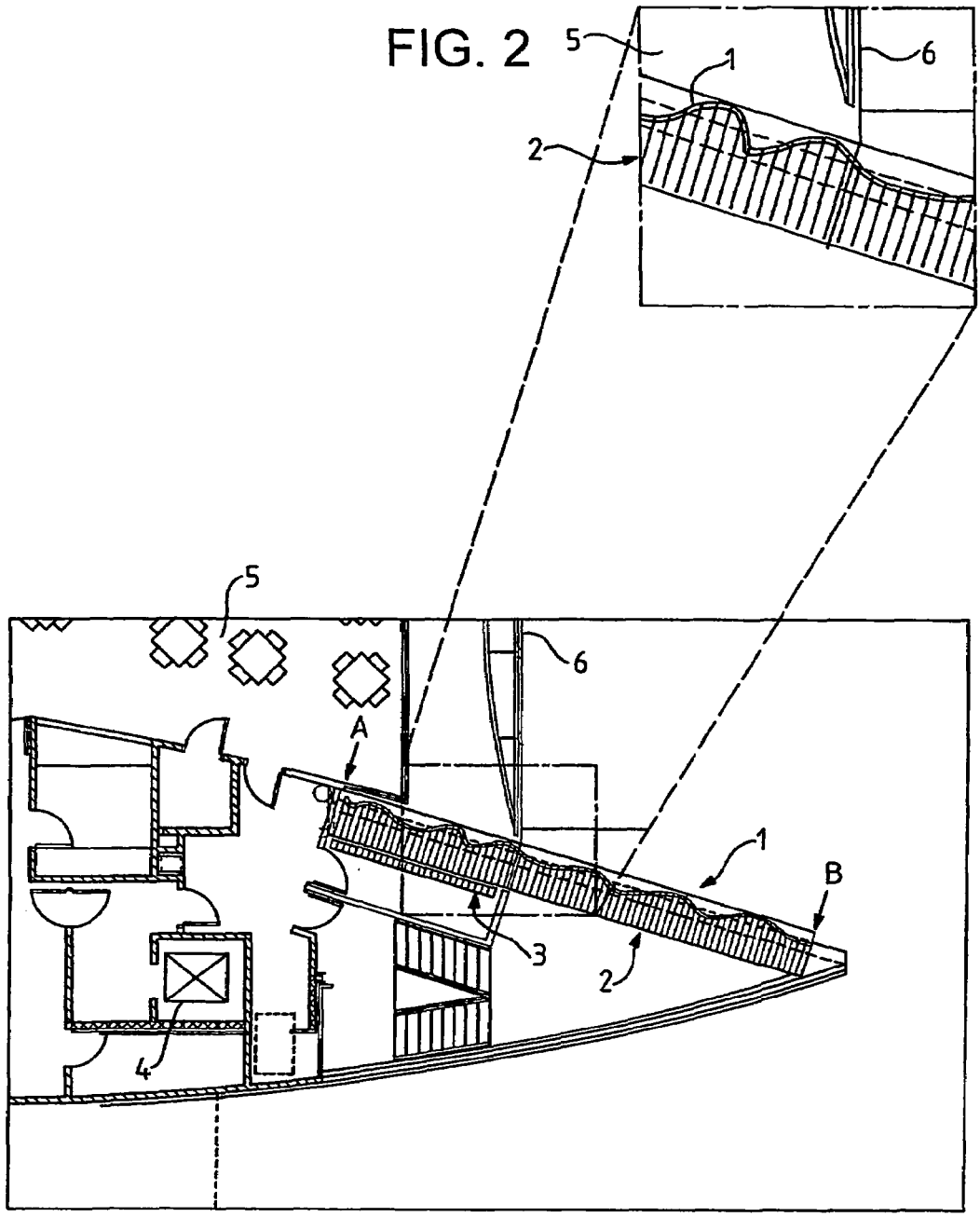
FIG. 1 is a plan view showing the first prototype of a display system in accordance with the present invention when installed in a building.
FIG. 2 is an enlargement of part of FIG. 1.

FIG. 1 shows how a display system in accordance with the first prototype of the present invention may be installed as a wall in a building. The screen 1 of the display apparatus of the display system extends from position A to position B. Behind the screen is a grid of actuators 2 in the form of pneumatic pistons. Ancillary equipment 3 such as valves, compressors etc., necessary for physically powering and controlling the pneumatic pistons 2 is positioned in a room of the building behind the screen. The valves are connected by plastic pipes to the pistons. The room in which the ancillary equipment 3 is located acts as a service room permitting easy servicing of the components of the ancillary equipment.

The hardware of the electronic control system 4 is positioned in a separate room remote from the ancillary equipment.

The screen 1 is positioned so as to be visible from both outside the building and from within an atrium 5 of the building. The screen 1 extends forwards through a glass facade 6 at the front of the atrium. Thus, a viewer positioned outside the building may see both end A of the screen in addition to end B of the screen. Therefore the viewer could see a surface effect displayed on the screen that propagates from end A along to end B.

Figure 3:
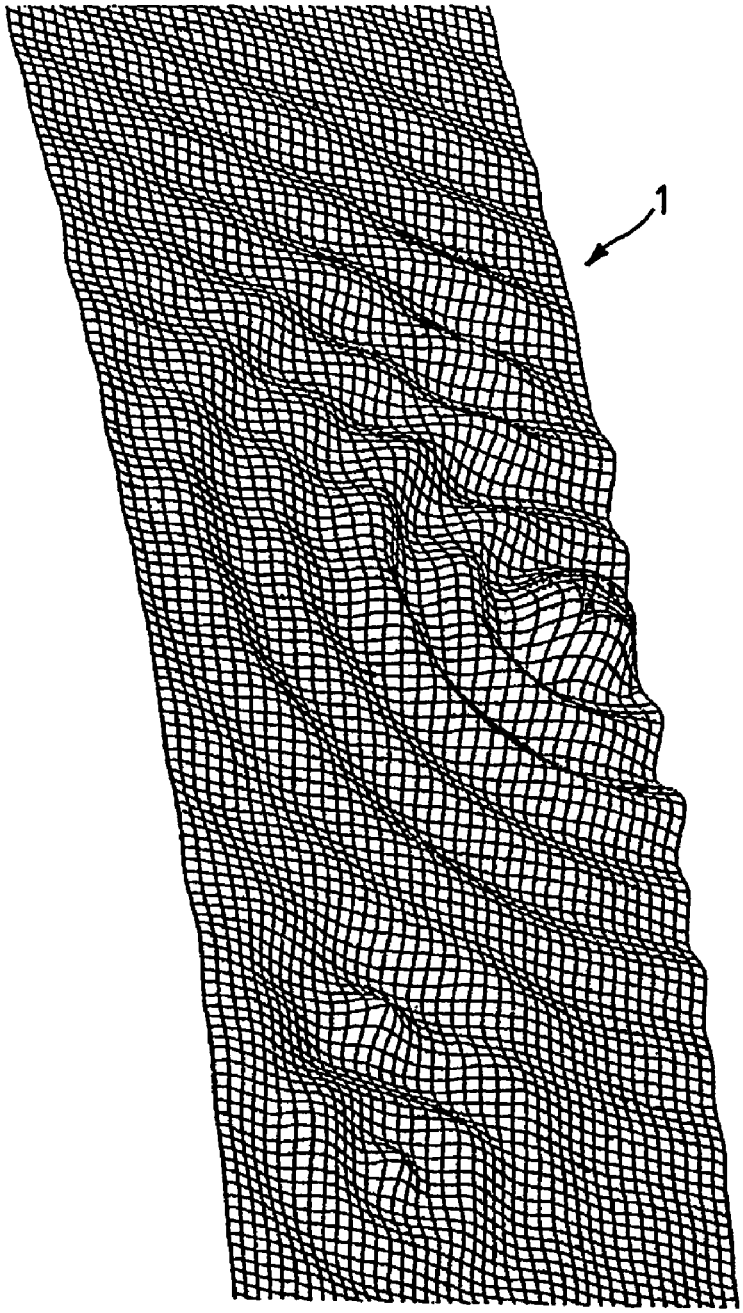
FIG. 3 is a perspective view illustrating the type of ripple effect that may be achieved using a screen of a display apparatus of the first prototype in accordance with the present invention.

FIG. 3 illustrates the type of dynamic 3-dimensional surface effect that may be produced on the screen 1. It is intended to be an image showing the waves propagating from a disturbance produced on the surface of a body of water.

Figure 4C:
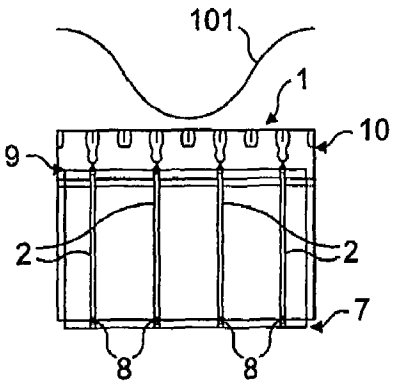
FIGS. 4A, 4B and 4C are respectively an elevation (front view), a vertical section and a plan (overhead view) of the first prototype of the display apparatus.
Figure 4B:
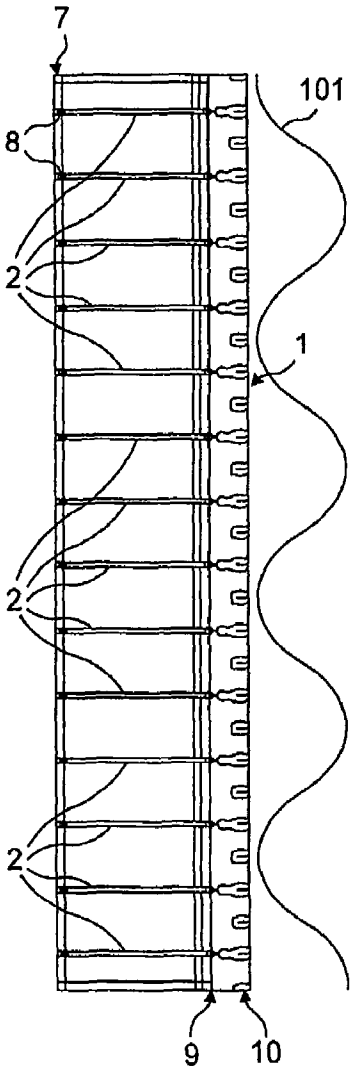
Figure 4A:
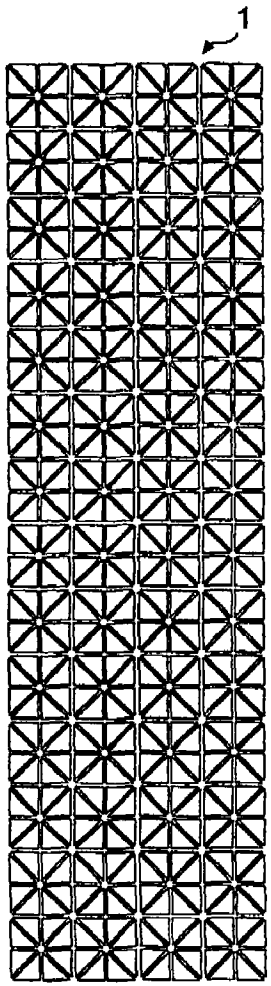

FIGS. 4A, 4B and 4C illustrate the first prototype of the display apparatus. It has a bed of pneumatic pistons 2 arranged in a grid with square grid cells. The pistons are supported at the rear by a structural frame 7. The rear end of each piston 2 is connected to the structural frame 7 by a damped pivot 8 (not all of which are marked up on FIG. 4B for reasons for clarity). The front ends or heads of the pistons 2 are interconnected by a web of springs 9 which are carried by the frame 7 and serve to hold the heads of the pistons generally in the correct positions whilst permitting minor deviations upon operation of the display apparatus.

The bed of pistons 2 drives a flexible surface comprising generally-triangular metal facets which form a dynamically reconfigurable display surface or screen 1.

In FIG. 4B, the screen 1 is shown in its flat state. This is its quiescent or home position. In front of that position is shown a sinusoidal deformation 101 of the screen which may be produced upon operation of the actuators 2.

The heads of the shafts of the pistons are flexibly connected to the facets of the screen 1 by means of connection devices (jointing devices) also called "squids" because many of them have eight legs.

Each piston 2 has its shaft fixed at its front end to an eight-legged connection device [which is described in more detail with reference to the later figures] and each leg is secured to a 45° corner of a respective facet of the screen, at a connection node of the screen The facets need to be flexibly connected together at each of the connection nodes of the screen 1 so that the screen as a whole may flex like a skin.

In order to reduce the number of pistons 2 that are needed, not every connection node of the facets is driven by a piston. Along orthogonal axes of the screen 1, only every second connection node is driven by a piston. The pistons effectively define a grid of square grid cells. At the corner of each grid cell is a piston 2 connected via an eight-legged connection device to eight 45° corners of eight facets of the screen. At the middle of each side of the grid cell there is a connection node at which four 90° corners of four facets are flexibly connected together. This is done by means of a four-legged connection device which floats freely. At the centre of each grid cell is a connection node at which eight 45° corners of eight facets are flexibly connected together, by means of an eight-legged connection device which floats freely. Along the edge of the screen as a whole are some connection nodes of the type at which two 90° corners of facets are flexibly connected together. This is done by means of a floating connection device having two legs. There are also some connection nodes at which four 45° corners of facets are flexibly connected together. This requires the use of a four-legged floating connection device.

At the four corners of the overall screen, there are positioned two-legged floating connection devices which flexibly connect together and support the two facets at each corner of the screen.

The screen of the prototype shown in FIGS. 4A, 4B and 4C is 3.5 metres tall, 1 meter wide and 0.7 metres deep. It has a 9×29 array of connection nodes, giving a total of 261 connection nodes.

In relation to the pistons 2, there is a 4×14 array or grid of pistons. Thus there is a total of 56 pistons.

In relation to the flexible connection devices which connect the front ends of the piston shafts to the facets of the screen, and which also flexibly interconnect the facets, there are 56 eight-legged connection devices carried by the pistons.

There are 39 floating eight-legged connection devices. There are 94 floating four-legged connection devices.

Along the edges of the screen, there are 32 floating four-legged connection devices [effectively half of an eight-legged floating connection device] and 36 floating two-legged connection devices [effectively half a four-legged floating device].

At the corners of the screen, there are four two-legged floating connection devices.

The floating connection devices may be freely floating or else gently held in position by springs or the like, but not to such an extent that they adversely affect the surface configuration that the pistons 2 will, in use, try to impart to the facets of the screen.

As already mentioned, each piston 2 drives eight facets. Thus the prototype that is shown has 448 generally-triangular metal facets.

Figure 5:
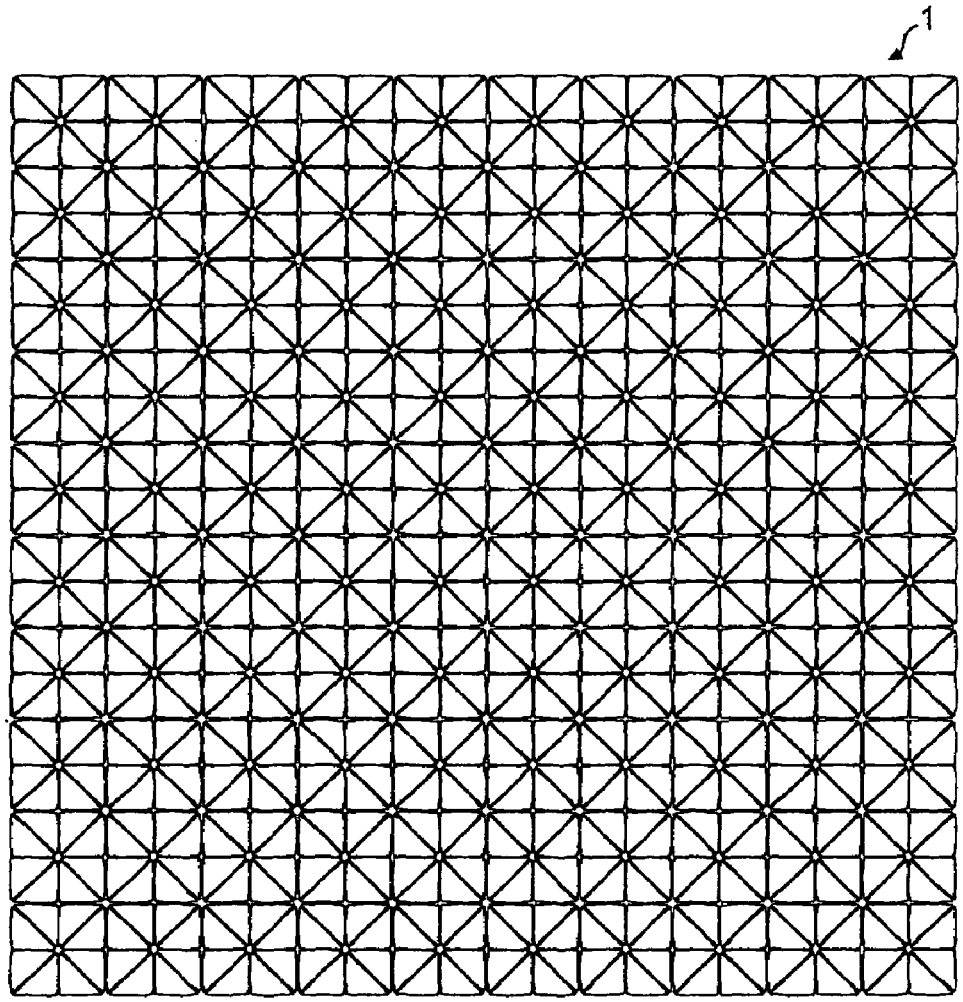
FIG. 5 is a front view of a screen of a modified version of the first prototype.

FIG. 5 is a front view of a variant of the screen of the prototype shown in FIGS. 4A-4C. The screen as shown in FIG. 5 is constructed in the same general way but is square in overall shape, rather than rectangular.

Figure 6:
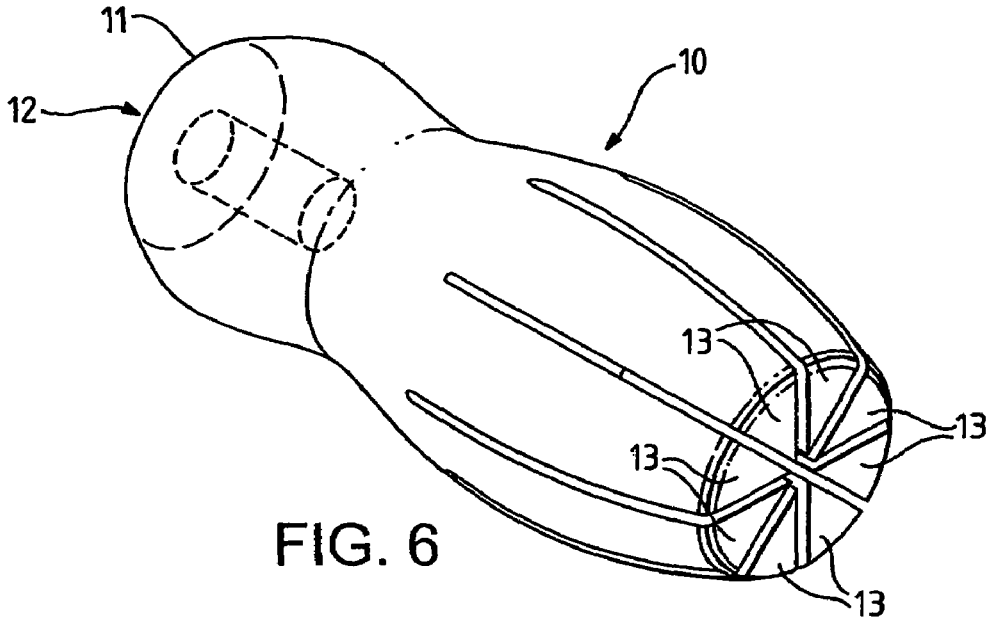
FIG. 6 is a perspective view of a connection device (jointing device or "squid") of the first prototype.

FIG. 6 is a perspective view showing one of the eight-legged connection devices for mounting on the front end of the shaft of one of the pistons 2, for flexibly supporting eight facets. The connection device 10 is made of natural rubber or synthetic rubber such as neoprene. It is cast and has metal fixings embedded in it or bonded to it to permit connection to the piston shaft and the eight facets. The base 11 has a central hole 12. The front end of the connection device has eight legs 13 which are connected to respective facets of the screen. When unstressed, the legs are as shown in FIG. 6, i.e. closed up together. When the connection device is driven forwards by a piston, the legs 13 will splay apart to permit the facets to move apart as they are also pushed forwards.

The resilience of the natural rubber or synthetic rubber may be varied to alter the characteristics of the connection device, and the overall form of the connection device may be varied as long as it achieves the function of allowing the legs 13, connected to the surface facets, to open and close freely, and for the connection device to be able to bend under stress.

Figure 7A:
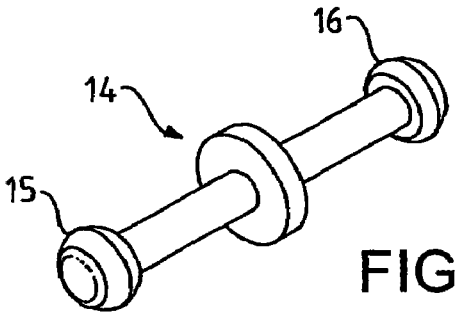
FIGS. 7A, 7B and 7C are a perspective view, a side view and an end view respectively of a metal stud used in the connection device of FIG. 6.
Figure 7B:
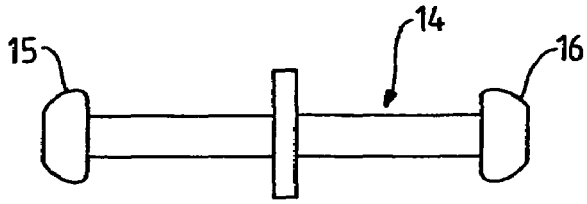
Figure 7C:
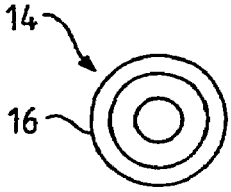

FIGS. 7A-7C show a metal stud 14 which has one end 15 which is cast into each leg 13 of the connection device 10. The other end 16 is connected to a respective corner of a respective facet, e.g. by crimping.

Figure 8:
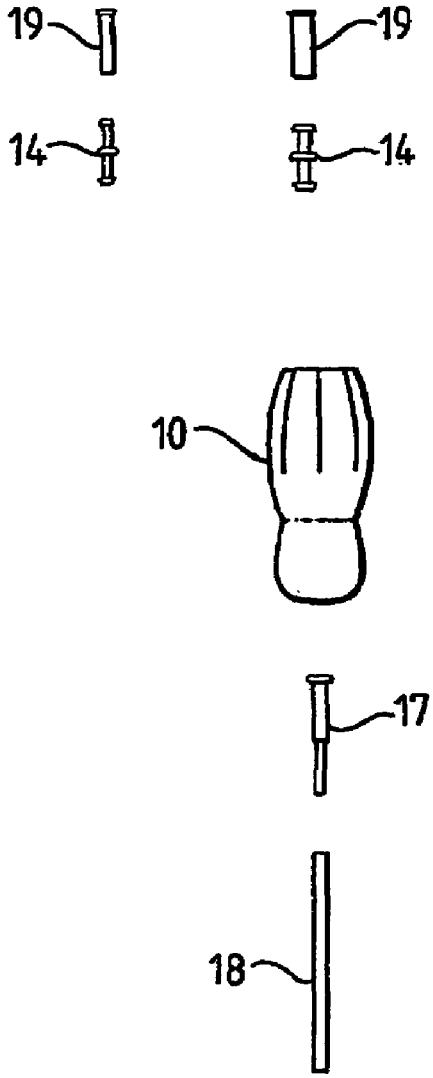
FIG. 8 is an exploded side view of the connection device of FIG. 6, showing how it is attached to a facet of the screen and to a piston actuator.

With reference to FIG. 8, a metal pin 17 is cast in the hole 12 in the base at the rear end of the connection device 10 and is fixed to the front end of a piston shaft 18 of a piston 2 by means of a cotter pin.

Eight metal studs 14 are cast into the eight legs 13 of the connection device.

On the back surface of each facet of the screen, at the three corners of the facet, are welded rigid sleeves 19 (rive nuts). The rigid sleeves 19 are then crimped to the forward ends 16 of the metal studs 14 in order to provide the connection between the piston 2 and eight facets, and also the flexible connections between the eight facets themselves.

Figure 9:
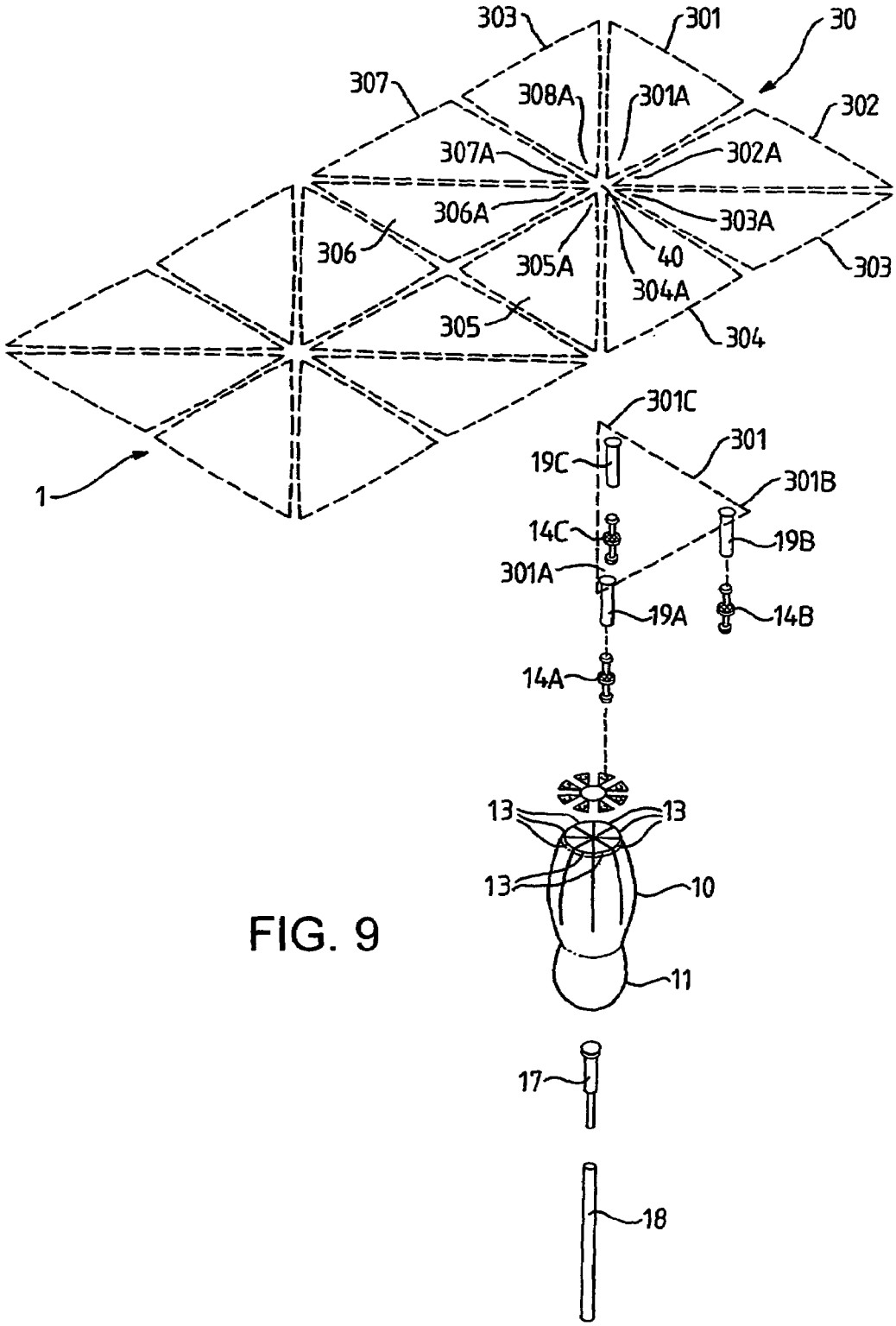
FIG. 9 is an exploded perspective view of the connection device showing how it is attached to facets of the screen and to a piston actuator.

The connections of the connecting device 10 are also shown in FIG. 9. In relation to the facets 30 of the screen 1 it is the eight facets 301-308 which are flexibly connected together at connection node 40 by the illustrated connection device 10.

Specifically, the eight 45° corners 301A-308A of the eight facets 301-308 are flexibly connected together by the illustrated connection device 10.

The facet 301 is shown for a second time underneath the main depiction of the facets 30. The 90° corner 301B of the facet 301 will be flexibly connected to the similar corners of the adjacent facets (one of which is facet 302) at the relevant connection node by a variant of the connection device 10 which is floating (unsupported on a piston 2) and has only four legs 13.

The other 45° corner 301C will be flexibly connected to the seven similar corners of the other facets (one of which is facet 308) at the relevant connection node, by means of a floating version of the eight-legged connection device 10.

Figure 10:
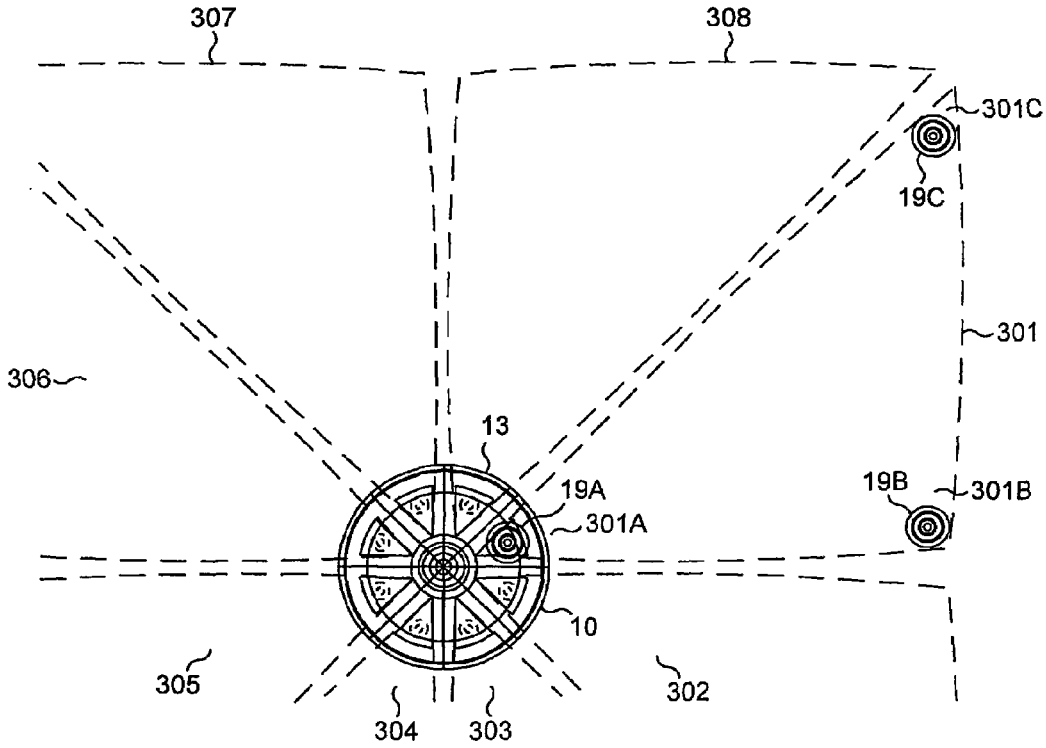
FIG. 10 is a front view of several facets of the screen, showing a connection device positioned behind the facets at a connection node.

FIG. 10 shows the assembled condition of FIG. 9. It shows how the facet 301 is supported at its three corners. It may also be seen that all three edges of the generally-triangular triangular facet 301 are slightly convex so that, at the corners at the connection nodes, there will be slightly more room for relative movement between the facets to prevent them from clashing when the pistons 2 are actuated to display an image on the screen.

Figure 11:
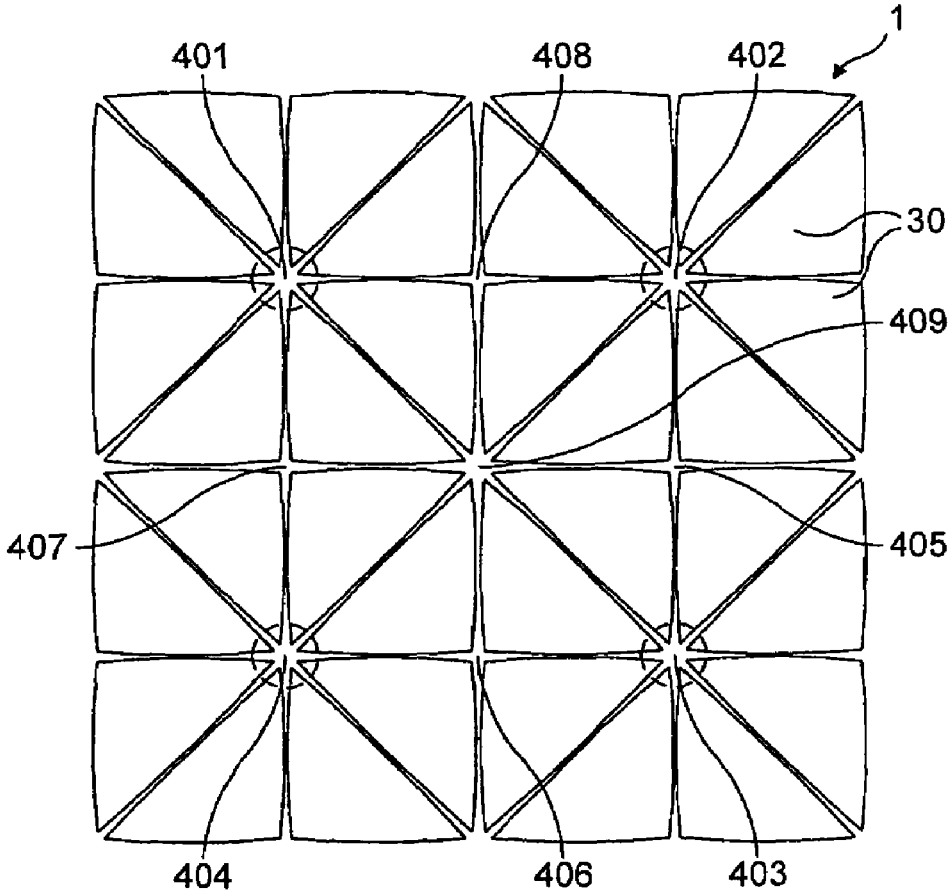
FIG. 11 is a front view of the facets of the screen, showing centrally a square grid cell having a connection device at each corner.

FIG. 11 is a front view of some of the facets 30 of the screen. The four connection nodes 401-404 define a square grid cell of the overall grid of pistons 2. At each of the connection nodes 401-404, a piston 2 is flexibly connected to eight facets by one of the eight-legged connection devices 10.

Along the four edges of the grid cell, each edge has a connection node 405-408 at which the four facets are flexibly connected together by a floating four-legged connection device.

At the centre of the grid cell, there is a connection node 409 at which the eight facets are flexibly connected together by a floating eight-legged connection device.

Although the first prototype illustrated in the drawings has fewer actuators than there are connection nodes, it would be possible, if funding and the size of the actuators permits, for there to be more actuators. The limit case would be for every connection node to be driven by an actuator.

In the first prototype, the square grid cell of pneumatic pistons has a 200 millimeter length. The pistons have a throw or extension of 600 millimeters and operate at 7 bar pressure. They require a compressor which feeds a manifold, linked to which are a series of solenoid valves which release air via plastic pipes to the pneumatic pistons.

The pistons are held by neoprene gaskets at the bases of the pistons and by a series of stainless steel springs at the heads of the pistons. This allows some relative movement of the pistons when they extend to different extents.

The first prototype display apparatus can achieve frequency of about 2 Hz (i.e. two 600 millimeter displacements per second).

With the first prototype, fluid surface deformations of the screen may be produced.

C. Discussion of the Second Prototype

Since developing the first prototype, the invention has been developed further to produce the current (second) prototype.

With the second prototype, there are two general possibilities for the Control System:

An Open-Loop System (where there is no precise control of the actuators' position)

A Closed-Loop System (where the actuators are equipped with positional control).

The Closed Loop System may comprise an integrated positional control (where the actuator is simply told where to go directly), or an independent positional control (which monitors the actual position of the actuators and feeds this information back to the Control System which then makes any adjustment necessary in a subsequent command).

Below is a specification for the Open-Loop System for the second prototype, and it is followed by an outline specification of a Closed-Loop System for the second prototype.

C.1 Specification for the Open-Loop System

C.1.1 Control System

Figure 12:
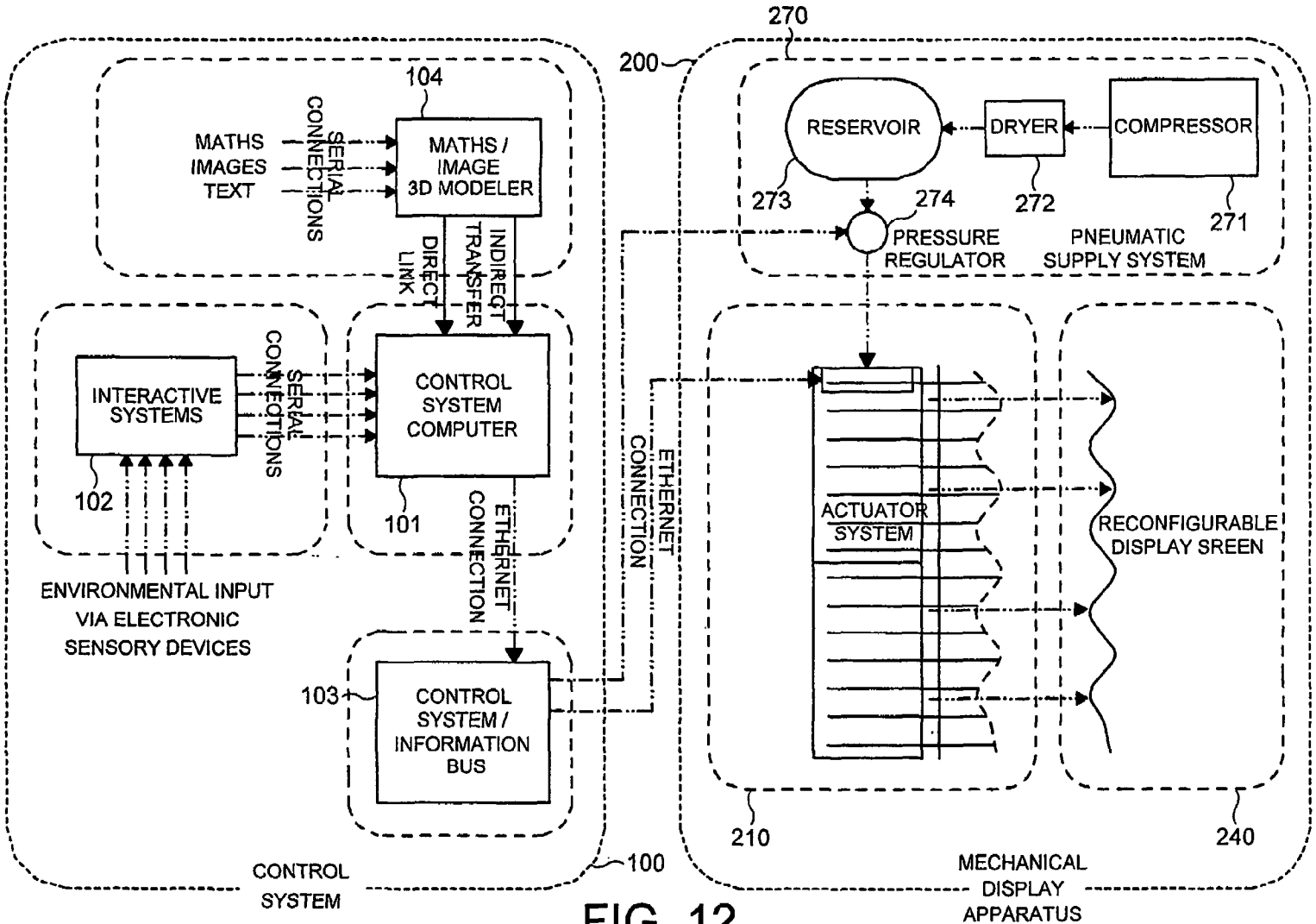
FIG. 12 is a diagrammatic illustration of an embodiment of a mechanical display apparatus comprising a pneumatic actuator system driving a reconfigurable display screen.

The control system 100 of the second prototype is illustrated diagrammatically in FIG. 12. It includes a computer 101 which has a Screen, Keyboard and Mouse, Serial Connections for video/microphone input, and an Image Acquisition Board Video.

The Control System Computer 101 is required to a. process the information from the electronic sensor devices received from the interactive systems 102,
b. generate or call up data files of patterns to be displayed,
c. perform the input and output interface control functions as well as the serial connection and other internal control functions.

On-board memory is required to store a. the software as well as dynamic and static variables
b. the data files of the patterns to be run on the screen.

The screen and keyboard/mouse are required for the user to interface with the system.

The interactive systems 102 is able to receive input from a variety of electronic sensors: such as Video Cameras, Microphones, Ultrasonic/Infrared Sensors, Motion Detectors, Temperature/wind sensors, Building Management Systems and Pressure Pads.

A control system/information bus 103 is used to output to the array of actuators of the Mechanical Display Apparatus via an Ethernet link to the CPU of the Control System.

A mix of customized and off-the-shelf software is used for a. taking input from the electronic sensors (video and microphone)
b. selecting stored data files generated by a Mathematical/Image 3-D Modeller 104, and c. providing output to the Control System via an Ethernet cable to an Ethernet Card of the Control System.

The software part consists of the following modules: Input functions, Output functions, Display functions, Keyboard functions, RS232C functions (serial connections), and Electronic sensor information processing.

C.1.1.1 Software Functionality

The Software part has been developed in C++ and the associated binary is stored in the onboard memory of computer 101. The software has been devised such that it can be readily updated and modified by e-mailable .exe files to allow for flexibility of possible use. Currently the control system has no modem, but this can evidently be included to facilitate downloading new software.

The software provides data to the actuators of the mechanical display apparatus. In a 'closed loop system' where there is positional control of the actuators, the output would include such positional information, information being fed to the actuators at a variable 'Frame Rate' that can be altered by the user according to the effect desired. Currently this can be any value down to the minimum output rate of the Control System, which is approximately 10 msec. In practice the solenoid triggering time is 16 msec, so the frame rate is not reduced below this.

The current second prototype, however, is an 'open loop system', where there is no positional control of the actuators, where the output is as a time instruction for triggering the solenoid valves of the actuators, with no positional information as such. The software of the current system has therefore been devised to allow the solenoids to be triggered at increments denoted as 'Step Rate', which is a variable that can be adjusted to effectively divide a full piston stroke into a number of discrete 'Steps'. In the current application 15 'Steps' correspond to one full stroke of the piston, allowing for quite fine positioning of the pistons and the surface which is attached to them.

The Software then analyzes the input information (whether the positional data from the mathematical image/modeller 104 or the input from the electronic sensory devices) and assigns it one of 15 positions. In 'video mode', for instance, it converts the image into 15 greyscales, and in 'microphone mode' it converts the volume or pitch into 15 levels. The Software then outputs a signal that triggers the solenoid by this number of increments, effectively taking the piston to the corresponding position.

The Software then allows for variability of 'Step Rate' and 'Frame Rate' such that the user may control or 'balance' the dynamic functioning of the device. When the Frame Rate is faster than the Step Rate, which is necessary to allow smooth functioning of the device, the Software allows for addition and subtraction of the Step Rate, as per the following example: Step Rate=20 msec; Frame Rate=10 msec. The piston is instructed to go 3 Steps (ie the valve to open 60 msec). 10 msec later the piston is instructed to go another 2 Steps (ie the valve to open a further 40 msec). The Software adds 60 msec and 40 msec=100 msec but allows that the solenoid has already been open for 10 msec, so subtracts 10 msec=90 msec. Then the next instruction is received.

This is the principle for translating sound or movement to a positional output command, and the variability of step and frame rate allows the user to empirically determine the best range of operability of the device for each particular pattern, and to be able to save them as variables that are attached to a particular data file.

C.1.1.2 Software Functioning

The Software performs multiple functions, both background (automatic) and foreground (ie user-operable via the user interface, which is shown on the screen and operated by mouse and keyboard):

Background Functions

Scanning Electronic Sensors

A series of time/interrupt tasks continually scan the input from various electronic sensory devices. This monitors the current state of all devices attached to the system. When any particular device is disactivated via the User Interface, so the Software ceases to scan for that device so as not to slow the system.

Pattern Deployment

The Software Initiates Commands to Either Deploy Patterns from:

a. the Mathematical Image/Modeller 104 (if the Control System Computer is calculating real-time)
b. the Data Files (if the Control System Computer is not calculating real-time)
c. the Electronic Sensors by analysis of input as 15 -step potential and output of 1 to 15 step commands Checking The Software performs a final checking to ensure that there will be no overstressing of the display screen. This is a simple calculation of the slope of the surface, which is input via the user interface as a variable, derived by empirical testing.

Output

The Software then passes the data array via the Ethernet connection to the Control System 103 which boosts and distributes the signals to the output drivers.

Pressure Regulation

The Software also outputs to a variable pressure regulator to allow the speed of the Mechanical Display Apparatus to alter, and it does so in proportion to the number of pistons that are operating in any given array—ie it balances actual movement with available air. This is achieved by the Mathematical/Image Modefler 104 assigning a variable which is in proportion to the number of pistons operating.

Foreground Functions (ie Operable via the User-Interface)

The User Interface allows the user to direct the Software to perform in a variety of different ways:

Settings

This relates to the Step Rate and Frame Rate referred to above, which allow refinement or 'tuning' of the movement, and also to smoothing and retracting functions.

a. Step Rate

This allows the speed of the time-signal to the solenoids of the actuators to be varied such that for a given pressure or pattern 15 steps corresponds to a full stroke. This variable will be saved as part of a data file or according to input/output mode. Currently the minimum value is 10 msec, and it can be increased in increments of 1 msec to any value.

b. Frame Rate

This allows the refresh rate of information to the entire matrix of solenoids to be varied, and it is independent of the Step Rate. Currently the minimum value is 10 msec, and it can be increased in increments of 1 msec.

c. Fade

This is a variable that causes effects to fade to zero with variable time so as to avoid the patterns stopping too abruptly. This effectively multiplies the position of the pistons by a smaller and smaller fraction such that pattern effectively 'fades' to zero. This allows different patterns to sequentially follow one another smoothly.

d. Retract

This has the effect of immediately retracting all the pistons, and is used as an emergency stop to the system by the user, or simply to reset the pistons to zero. ie it is an abrupt version of 'Fade'.

e. Differential

This function is a variable that is used to adjust the time of return stroke of the pistons. This is required since the shaft of the piston reduces the surface area available to the air to push against the plunger in the cylinder, hence slightly decreasing the speed of the return stroke versus the out stroke. This would otherwise result in incremental 'creep' of the pistons outwards, since they do not quite return to their origin point if the solenoid is triggered for the same length of time on out stroke and return stroke. I have sought to compensate for this by adjusting the physical mechanism to provide fractionally more air on the return stroke, since varying the control signals is liable to interfere with the performance of the piece.

f. Smoothing

This double-checks an output prior to sending instructions to the solenoids to verify that it corresponds to the physical limits of the system and elastic surface. It may be switched on or off, the default being 'on'. There is a variable that allows the user to set the maximum angle of the surface.

Input

The User Interface allows a user to select between a variety of different inputs as the 'active' mode, such that the apparatus may be variously interactive. These are as follows:

a User Input

The user can actively select any of the available effects, acting as a Video Jockey or Disc Jockey (VJ/DJ) to deploy effects 'real-time', using the mouse to deploy effects. Hence a pattern may be directly selected and run, the various parameters (Step Rate, Frame Rate, etc) selected by the user directly.

b. Mouse Input

The user can actively draw lines and patterns real-time on the screen, selecting the amplitude and extent of the effect by varying Definition parameters. A Fade parameter also selects the duration of an effect.

c. Sensor Input

Any or all of the electronic sensors can be selected as 'active', serving to trigger effects according to the Mode selected (Pattern, Image, Video, Microphone, Random—see below). The triggering threshold may be set by the user to make the system more or less 'responsive' to input. There is a variable (the 'Sensor Variable') which the user can vary to set the threshold for sensor triggering.

d. None

Here the Software operates independently, and so does not exhibit interactive characteristics.

Output

This allows the user to select between various different output modes of the control system, allowing a variety of generative processes to become 'active'.

a. Pattern Mode

This causes the software to deploy patterns generated by the Mathematical Modeller 104, either by real-time calculation or stored as files.

b. Image Mode

This causes the software to deploy images generated by the Image Modeller 104, either by real-time calculation or stored as files. These may be text, numbers, logos or abstract images created as described below.

c. Video Mode

This causes the software to deploy images generated directly from the video input, which is analyzed as 15 grey scales and reduced to an image with as many pixels as there are actuators, ie if there is a matrix of 40×23 pistons, the Software approximates the image of the video camera to an image of 40×23 pixels such that each pixel moves to one of 15 positions according to the shade of grey of a 15-shade grey-scale image.

The user can enter the format of the pistons numerically ('Piston Format'), and the user can decide whether the video image is cropped or distorted if the piston array does not correspond to the proportions of the video image ('Pixel Format').

d. Microphone Mode

This causes the Software to deploy patterns as a direct image of the input of the microphone, which analyzes the volume and pitch in terms of a 15-step range, assigning a corresponding 'Step' to each.

e. Random Mode

This causes the Software to select between all the previous modes in random or pre-programmed sequences, such that it operates independently.

Program

This allows the user to determine how the system will operate without a user VJ/DJ. This can evidently be left entirely to chance (see 'Random' mode below), or entirely pre-programmed (see 'Choreograph' mode below).

a. Choreograph

This allows the user a wide range of control over the parameters of the system, so as to be able to effectively map out the range of effects available to the system when it is in operating independently. The user can also pre-ordain the sequence of patterns and effects that will be sequentially deployed by choosing a list from the Menu, below.

b. Random

This allows the user to determine that when operating independently the Control System will determine at random the parameters and range of effects that it deploys.

Menu

This lists the various patterns stored (either as formulae or as data files) on the Control System Computer 101, breaking them into general categories such that the user can rapidly compose combinations of visual effect. Each generic category is then further sub-divided, and there is potential to have embedded menus to increase the number of functions that are available. The current categories are as follows:

a. Surface Effects

These describe patterns that operate across the entire surface. Sub categories include:

1. Fluid Effects

Linear Waves

Radiating Waves

Multiple Waves

2. Geometric Effects

Linear Effects

Radiating Effects

Multiple Effects etc. . . .

b. Patterns

These describe discrete figures that are non-figurative, but differentiated from the background effect.

1. Lines
2. Rings
3. Vs
4. Bumps etc. . . .

c. Glyphics

These describe figures that are figurative but not alphabetic, numeric or representative, these being grouped collectively in the 'Graphics' category below. Effectively, then, they are more complex Patterns.

d. Graphics

1. Logos
2. Images
3. Text
4. Abstract etc. . . .

Parameters

This is devoted specifically to the Menu above, whereby the parameters of any particular effect are displayed as variables which can be manipulated by the user.

Information

This gives a resource for information about the Control System in general, and also about the current state of operations. It includes the following subsections:

a. Status

This displays the current activity of the Control System b. About

This contains information about the system in general c. Help

This is a help menu to list possible errors and/or problems, and to offer help as to the possible remedy.

d. Quit

This is to shut down the Control System software and to terminate operation of the apparatus.

C.1.1.3 Description of Functioning of Control System

The Ethernet Card takes the input via the Ethernet cable from the Control System Computer 101 and feeds it to the CPU of the control system/information bus 103. Communication rate is limited to the speed of the Ethernet Card, allowing data files to be transferred quickly enough that patterns can be run without staccato movement of the actuators. This is achieved by a customized software program written in C, but it could be achieved by off the shelf software such as FINS Gateway or Compolet which allow the Computer to communicate with the PLC via languages such as Visual Basic in Excel.

The Central Processing Unit (CPU) takes the signals from the Ethernet Card and distributes them to Output Cards where the signal is amplified before being relayed to the solenoid valves of the actuators. The performance of the CPU limits the speed of information flow, and needs to be fast enough to allow patterns to be run without staccato movement of the actuators.

The output cards turn on a relay to amplify the signal given from the CPU, the output cards having their own dedicated 24 v power supply. These then forward the signal to a series of distribution boards whose terminals are connected to the wires from the solenoid valves.

C.1.1.4 Mathematical/Image 3D Moduller

This comprises a proprietary application program that can be used to generate and edit patterns to be run on the display screen. It is able to generate patterns mathematically and graphically using mouse and keyboard as a user interface. In 'graphic' mode the user can draw or scan images which the program interprets as grey-scale 3-D maps which are saved to file. In 'mathematical' mode the user selects a formula, configures its parameters appropriately, visualises a 3-D pattern and records it to a file. In both cases the file is in a format that can then be read by the Control System Computer 101 in order to then display the pattern on the wall.

The Mathematical/Image Modeller 104 can also be used to calculate the piston positions in real time, therefore allowing full interactivity between the user or sensory device and the movement generated by the display screen. However, the processing of the position matrix demands a powerful computational device (even parallel processing), and I have therefore allowed that the software can work either as a file-generating program (where pre calculated sequences saved to file are deployed) or as a real-time calculating device, the latter requiring a more powerful computational device.

The first two modules of the Mathematical/Image Modeller (Pattern Generation & GUI) are designed to interface directly with the Control System Computer 101. The other modules described (Parser, etc.) were developed to allow the Mathematical/Image Modeller 104 to stand alone, discrete from the Control System Computer 101.

Pattern Generation

The Pattern Generation module generates data to determine the positions of the pistons. It uses both mathematical formula to obtain the positions by calculation, as well as having a grey-scale modelling capacity to be able to display other 3-D patterns (logos, etc.), ie it can interpret scanned 2-D images in grey-scale into 3-D reliefs.

Maths Generation

The mathematical equations are implemented in C as independent functions, but there is capacity to add several functions to give multiple effects (for example 'motor boat' may be added to 'droplet'). Although C has been used, in principle any computer language may be used. These formulae are parametric such that the parameters (amplitude, wavelength, duration, etc) can be readily varied to allow a multitude of possible effects.

The inputs to each function are info, xi, yi and t, where:— info specifies the parameters specific to the pattern (eg initial centre, amplitude, decay, etc.);

xi and yi specify the position of the piston;

xi can be any floating point value in the interval [0, W], where W is the width of the wall;

yi can be any integer in the interval [0H], where H is the height of the wall;

and t specifies the time for which the position will endure.

Calculating such functions gives the position of each piston.

There are two basic structures for the mathematical calculation:

the agPGPerturbInfo structure and the agPGPerturbEvent structure.

The agPGPerturbInfo contains all the information that is specific to a formula (eg initial centre, amplitude, decay, etc.). This structure is passed as an input to a formula to calculate a piston's position. The agPGPerturbEvent then contains both a formula and its associated information, agPGPertubInfo. When the user creates a perturbation on the wall, an agPGPerturbEvent is added to the list of perturbations, allowing multiple effects to be generated. The final piston position matrix is the product of each formula in the perturbation list being calculated and added to any other calculations that are current.

Since the functions contained in this module are calculated for every piston, and that the positions must be calculated at 0.01 sec, it is evident that the Pattern Generation module plays an important part in the performance of the entire system. Generating positions mathematically allows speed and precision, which gives possibility not only of generating a wide variety of effects, but of allowing a strict control of the degree of surface deformation (see 'smoothing' below).

GUI

Currently all the calculations are preprocessed (ie stored as precalculated data files), but it is intended that this module be integrated into the real-time functioning of the controller such that the performance is greatly optimized in being 'real-time'. This simply requires a computer or parallel-processing device that has sufficient computational power to keep pace with the number of pistons of a given device.

In order to speed calculation in the case of real-time generation, the Pattern Generator would be developed in DOS or any other high-speed language. But in principle it can be devised in any language such as Microsoft Windows.

As a further optimization I have created 'lookup' tables of the trigonometric functions that are used in the formulae to speed calculation, and various mathematical shortcuts can be devised to effectively streamline the calculation.

I have searched for a complete open source GUI library for DOS, using Open GUI. This library is written in C++, and to integrate C++ into C codes, we have had to deactivate the name mangling by using the 'extern "C" directive'.

The most complex component in the GUI is the wall's view. We used a 3D graphic library called Allegro to create it. This library is widely used in game programming for DOS. The compiler used is DJGPP. It is the port of GCC on DOS.

Smoothing

A smoothing module is used to verify that the physical constraints of the display screen are respected by the generated surfaces such that the physical surface of squids and facets is never over-stressed. We have established for the current prototype that the angle between 2 adjacent facets never exceeds 40°, but this could evidently be any value. This constraint is verified at the maths level by making sure that the gradient of the functions never exceeds 0,8 on the x or y axis. It also verifies that the surface does not violate the constraint when combining multiple formulae. For this we can use one of the following methods:

Take the maximum of f1 and f2

Take the minimum of f1 and f1

Take the average of f1 and f2

In the current application, Method 1 is used but by providing methods 2 and 3 to the user we would allow different looks for the surface.

'.aeg' files

File format:

1st line: "Aegis"+" "+number_of_frames+height_of_wall+width_

2nd line: 1st frame (HxW bytes), 1st row–3rd row– . . . – nth row—each byte contains a binary value of 0-15 representing a piston displacement. There is no delimiter between two bytes.

3rd line: 2nd frame

. . . mth line: m+1th frame

Description of Module

We have developed a method for storing positional data 'terrains' such that they can be visualized 'real-time' prior to calculation. Essentially our Mathematical Modeller 104 allows us to visualize a moving surface as a simulation. The only calculation during visualization is for the low-resolution screen image, so it can be seen in 'real-time'. The mathematical derivatives and parameters are then saved such that when the user is content with a particular effect the program then actually calculates the positional coordinates for the required number of actuators. Unless the computer is powerful, this will generally be slower than the real-time simulation, but sufficient frames will be saved to allow it to be played back in real-time. Ultimately the goal is to be able to generate effects on the mathematical modeller and exactly repeat them on the display screen in real-time. The current configuration of the device allows this. The frame rate can also be increased or decreased in the final device.

The matrix lists have however been kept to load an '.aeg' file.

Formula Parser

We have also allowed for inputting a formula directly in the application (ie not in the programming but in the actual functionality of the Maths/Image Generator). This functionality would require an extremely powerful computer to allow for a 'real-time' interface with the Control System where the piston positions are calculated in real time, since it would require the implementation of a formula compiler. However, where the displacements are to be preprocessed, we can implement it as a simple formula interpreter. In the current application this is implemented in the agPGPa module using lex&yacc (fiex&bison under DOS).

Formula File Specifications

The formula file is a text file that contains the definition of one formula It has a .txt extension and is located in the "formulae" directory under the directory of aegis.exe. When the application starts, it loads all formulae from this directory and then they can be selected in the application (the name of the file identifies the formula).

Positions are calculated from a math expression that can contain variables and simple function calls. The user can define as many variables as wanted with names of his/her choice. The maths functions are limited to sin, cos, atan, log, exp and sqrt, together with min/max functions.

To define a variable, use the syntax "MyVariable=Expression" on a single line. The formula that will be used to calculate position is the last text line of the file. The following variables are defined by the application:— x: coordinate of the piston horizontally.

y: coordinate of the piston vertically.

t: time at which we calculate the position x0: x coordinate of the perturbation's start (defined by mouse click)

y0: y coordinate of the perturbation's start (defined by mouse click)

vx: x velocity (defined by mouse movement during the mouse click)

vy: y velocity (defined by mouse movement during the mouse click)

Example of formula file for an elliptic surface:

$$x2=x-x0-vx*t$$

$$y2=y-y0-vy*t$$

$$16*\sin(3.1416*\mathrm{sqrt}(x2*x2+y2*y2))$$

Image Generation

Bitmaps

This part of the application functions with the most common image files (bmp, etc.), but may in principle be extended to all image formats. Currently I have implemented the module to read '.xbm' images. The '.xbm' format is used on the XWindows system for monochrome bitmaps. A black pixel represents a fully extended piston, and a white pixel represents a retracted one, with 15 grey scales between these two limits. To validate the 40° constraint on the angle between adjacent facets, I calculate the maximum displacement between two adjacent pistons and determine that the displacement should never exceed 8 shade gradients. This maximal displacement guaranties that the horizontal/vertical gradients of any bitmap never exceeds 0.8.

C.1.1.5 Interactive Systems

Characteristics of the Interactive Systems 102 will now be discussed.

Sound Interactivity

This I have achieved by linking several microphones to a Macintosh G4 computer equipped with hardware, software and a serial connection to the Control System Computer 101. In the second prototype communication is via the PC Com 1 port for speed of operation, but it could also be linked via any serial connection such as RS232C. Working on a Macintosh has allowed me to benefit from off-the-shelf sound recognition software (eg NATO) which allows the control system to readily analyze incoming sounds and create a series of output signals according to pitch, volume, etc.

I have also devised a customised sound-recognition system that works directly on the Control System Computer 101 (ie on PC), which avoids having to communicate between two different operating systems, but as yet lacks the sophistication afforded by the NATO software.

Software

NATO sound-recognition software

Functionality

On the Mac G4 I have written a program using NATO software that analyzes the pitch and volume of an input to a microphone, giving a series of outputs to the Control System Computer 101, which are then used to vary the data files sent to the Control System. In this way the reconfiguration of the screen is interactive with the sound input to the microphone. A droplet on the screen, for instance, may be triggered by a sharp noise, the wavelength varying with pitch and the amplitude with volume. Evidently such interactivity is variable and limitless.

I have found that pitchtracking is only effective if the microphone receives a continuous signal (like whistling), and so have devised the means of taking an average of the many frequencies involved in talking to allow effective voice activation.

Different microphones may be 'tuned' to different frequencies, and their output used to trigger different parts of the mechanical display apparatus, or to call up particular data files for deployment on the display screen. Currently the minimum sound volume is 35 dB and the maximum is 95 dB, but this can be varied.

NATO Analysis/Output

We input microphones to the G4 computer, analyzing the input using the NATO software, which creates a series of simple outputs to the Control System Computer 101 via COM 1. Currently pitch is mapped to the wavelength and volume to the amplitude, but any mapping is possible. Currently there are 3 microphones where we track the following:

Voice Tracking (low frequency range)

3 different pitches for voice frequency 3 different volumes for voice input ie 9 different possibilities for the voice Whistling Tracking (high frequency range)

3 different pitches for whistling frequency range 3 different volumes for whistling input ie 9 different possibilities for the voice When all three microphones are in the same pitch or volume range there is a signal created to trigger a particular effect on the display screen.

p=pitch: 1=low, 2=mid, 3=high v=volume: 1=low, 2=mid, 3=high

The Control System Computer sends one byte via COM 1 as the request for data, and then receives several bytes of microphone data in reply.

EXAMPLE byte 1 indicates say microphone number x byte 2 is say the volume of the sound obtained from microphone x byte 3 is the pitch of the sound obtained from microphone x byte 4 . . .

Control System Computer

The customized ICFIW software takes the incoming signals which it uses to trigger various different effects, allowing the user to select these at will. Since in the current application data is stored in files rather than calculated real-time, I have generated a series of similar effects with different amplitudes, wavelengths and speeds, such that subtle changes in sound input can be seen to slightly modify a particular pattern on the display screen. Evidently the possibilities are limitless for the interactive linkage of patterns with sound inputs, and as many microphones may be used as the software and hardware permits.

Video Interactivity

Generic Description

The video image may be used in a variety of ways, as noted above, to give 'interactive' potential. Currently the three modes are:

a. video triggering (where the video input merely serves as a trigger for effects). This is 'Triggering Mode'.
b. video image (where the actual video image is translated into a 3-D array of piston positions). This is known as 'Image Mode'.
c. video movement (where only the changes in the video input are registered and translated into a 3-D array). This is known as 'Motion Mode'.

Triggering Mode

Here the video image is interpreted by the Software to determine various thresholds that can act as a triggering signal for the deployment of effects. The Software 'reads' the changing pixels of the image, comparing frames to analyze rates of change and to compare the image with previous images. It then interprets the change and selectively deploys a particular effect or varies the parameters of a current effect The user is allowed to vary the threshold of the triggering, and to reassign the triggering linkage (ie change the patterns deployed as the result of particular effects).

Image Mode

The video input image is downgraded by the Control System Software to give a corresponding number of pixels to the number of pistons of the Mechanical Display Apparatus. Where the format of the Mechanical Display Apparatus does not suit the format of the video image, the latter is cropped or distorted according to the user's preference (see 'Foreground Functions' in the Control System Computer 'Software Functioning' section above).

The Control System Software also reduces the image to 15 grey scales, which it translates to give one of 15 positions to each piston (white=full piston extension, black=full piston retract, grey shades=intermediate 15 positions). This allows an actual image to be translated to the surface of the device, the 2-D grey-scale image being interpreted 3-dimensionally. Evidently the Software retains a memory of the piston's current position such that it might remain static if the grey-scale of its pixel does not change.

The frequency at which the pistons return to zero to 'refresh' the image can also be set by a user-controlled variable, and it may be subject to 'Smoothing' to avoid areas of extreme contrast in the image resulting in too great a differential movement between adjacent pistons which might over-stress the display screen.

Motion Mode

This functions as Image Mode, but where it is only the changing pixels of the image that figure in the output signal, all other non-changing pixels interpreted as a black grey-scale and so returned to zero. The effect of this is to show only the movement of the image—the areas of change (as such like the shadow of an event).

The frequency at which the pistons return to zero to 'refresh' the image can also be set by a user-controlled variable, and it may be subject to 'Smoothing' to avoid areas of extreme contrast in the image resulting in too great a differential movement between adjacent pistons which might over-stress the skin.

C.1.2 The Mechanical Display Apparatus

As shown in FIG. 12, the mechanical display apparatus 200 of the second prototype comprises a pneumatic actuator system 210 driving a reconfigurable display screen 240 and powered by a pneumatic supply system 270.

C.1.2.1 Actuator System

Hardware

Description of Actuator System

The second prototype comprises a series of modular aluminium structural frames that provide support for the actual pneumatic actuators and all ancillary springs, mountings, etc. The structural frames have diagonal bracing to resist deformation under dynamic loading from the actuators pistons). The frame has fixing tabs to allow connection to a wide variety of substructural elements such as masonry walls or steel frameworks, and bracing has been added to ensure resistance to live loads of the device. The frames may be arranged in a variety of different configurations as modules next to each other or spaced apart but operating together.

The valves used to control the actuators (pistons) are 5-port 3-position closed centres operated via two external solenoid pilots which are fed with an independent high-pressure line (typically 7 bar) from the pneumatic supply system 270. In the central position of a valve, all ports are closed (the piston will be at rest). Operating the solenoids will either extend or retract the piston rod. The valves have separate feeds to the solenoid pilots to allow low pressure air to be controlled by the valve (whilst maintaining a suitable pilot pressure). All valves are sub-base mounted in, for example, ten and six station manifolds. The manifolds allow a common air supply and common exhausts for used air.

The valve outlet ports are connected to the actuator (one port to the front cylinder chamber, another port to the rear cylinder chamber). The solenoids are mechanically sprung to rest in a central position where all ports are blocked off allowing no passage of air. Removing the electrical signal from either solenoid at any time will trap the air inside the cylinder causing the actuator to stop movement at its current position, pressure balanced on either side of the cylinder.

C.12.2 Reconfigurable Display Screen

Functioning

The principle of the reconfigurable display screen or surface 240 is to provide a supple but robust assembly that attaches to the ends of the actuators of the actuator system 210, permitting smooth dynamic motion to be attained. This is achieved in large part by the design of a series of rubber connection devices called 'squids' (so-called because of their 8-legged appearance), which are rubber components that link the actuators to the facets of the surface. These function by a combination of the geometrical and elastic properties inherent in the form and material of the 'squid' components.

The squids themselves are pressure-molded in natural black rubber, using high-grade steel molds milled and cut by both CNC machine and by hand. I have used a series of 9-cavity molds which may be reconfigured to allow for the various types of squid used in the display apparatus. Stainless steel pegs are placed into slots in the mold prior to casting. These squids have been developed as a series of prototypes which have been empirically tested to determine their optimal configuration, which balances between being too highly stressed and being too 'floppy'. I am currently developing a multi-cavity mold that fuses squids and facets as a continuous 'deep-folded' surface, such that each squid is joined to its neighbour by a continuous rubber facet; this obviates the need for a high-quality glue joint between the squid and the facet, since it is the rubber facet which now becomes load-bearing. The metal facet is able to be glued across the full surface of the rubber facet.

The ends of the piston rods are hollow and this permits stainless steel pegs cast in the rubber 'squids' to be inserted, drilled and pinned, providing a strong mechanical connection. The rubber 'squids' are then glued at the tips of their legs to a series of metallic facets, the glue joint requiring a highly specific operation to ensure a strong bond. The facets are glued to form a continuous display screen, combining piston squids and non-piston squids so as to minimize the weight (hence momentum) of the 'elasticated' surface (which reduces surface wobble).

The entire display screen allows repeated and rapid extension and retraction of the pistons, which transfer their movement to the reconfigurable screen. This is helped by the flexibility of the piston rods and the spring mountings and rear pivot mountings of the Mechanical Display, ie the entire assembly works to alleviate the build-up of local stresses.

The density and size of the pistons may be varied, and also the geometry of the facets.

Figure 13:
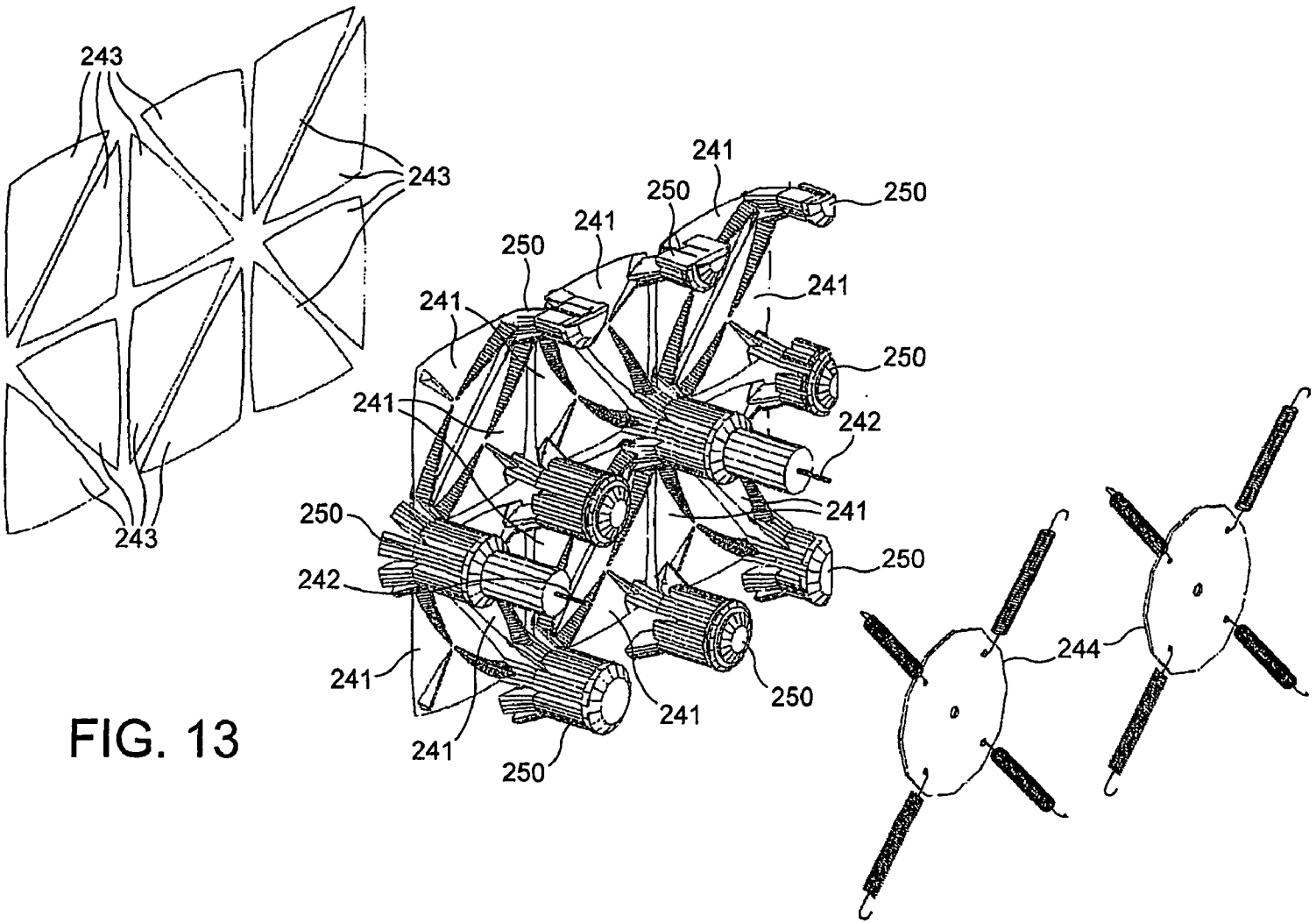
FIG. 13 is an exploded perspective view of a grid cell of the display screen of FIG. 12.

FIG. 13 is an exploded perspective view of a grid cell of the display screen 240. Connection devices 250 (so called "squids") are molded together with interconnecting rubber backing facets 241 to form an integral flexible screen. Some of the connecting devices 250 have eight forwardly-projecting legs each connected to a respective rubber facet Other connecting devices have four legs, others have two legs. In assembling up the grid cells to form the overall display screen, the edge rubber facets of one grid cell may be connected to spare edge legs of connection devices of the adjacent grid cell. Alternatively, where there are no spare legs, the two or four-legged connection devices at the edges of adjacent grid cells may be connected together at their bases (so as to leave the legs free to move) with connectors such as cable ties.

Some of the connection devices 250 are driven by piston rods 242 of the actuators. Others are undriven or floating.

Metal facets 243 are stuck onto the forward faces of respective rubber facets 241, to form the visible front layer of the display screen.

Each piston passes through a respective damping plate 244 which is laterally damped by springs 245 secured to the structural frame of the mechanical display apparatus.

C.1.2.3 Pneumatic Supply System

The pneumatic supply system 270 comprises a compressor 271, dryer 272, reservoir 273 and pressure regulator 274.

C.1.2.4 Operation

Figure 14:
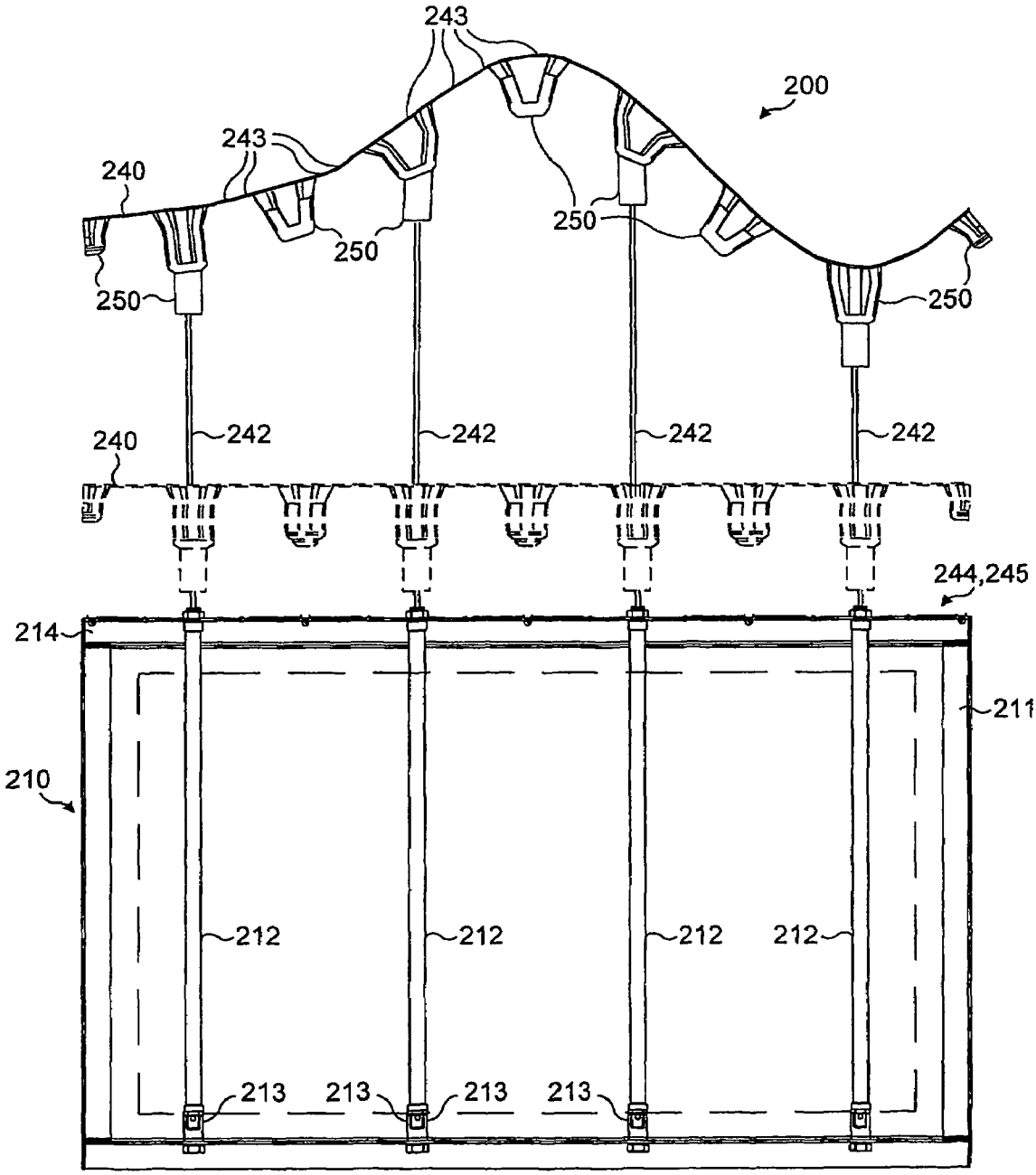
FIG. 14 is a diagrammatic end view of the mechanical display apparatus of FIG. 12.

FIG. 14 is a diagrammatic end view of the mechanical display apparatus 200. A structural frame 211 contains the pneumatic actuators 212 (the pistons) which have base pivots 213. At the top 214 of the frame 211 are the damping plates 244 and springs 245 for damping transverse movement of the pistons and display screen 240 which is shown in dotted line when at rest and in solid line when extended forwards. The transverse expansion of the screen is accommodated by the flexible connection devices 250. The articulation between adjacent metal facets 243 may also be seen.

Figure 15:
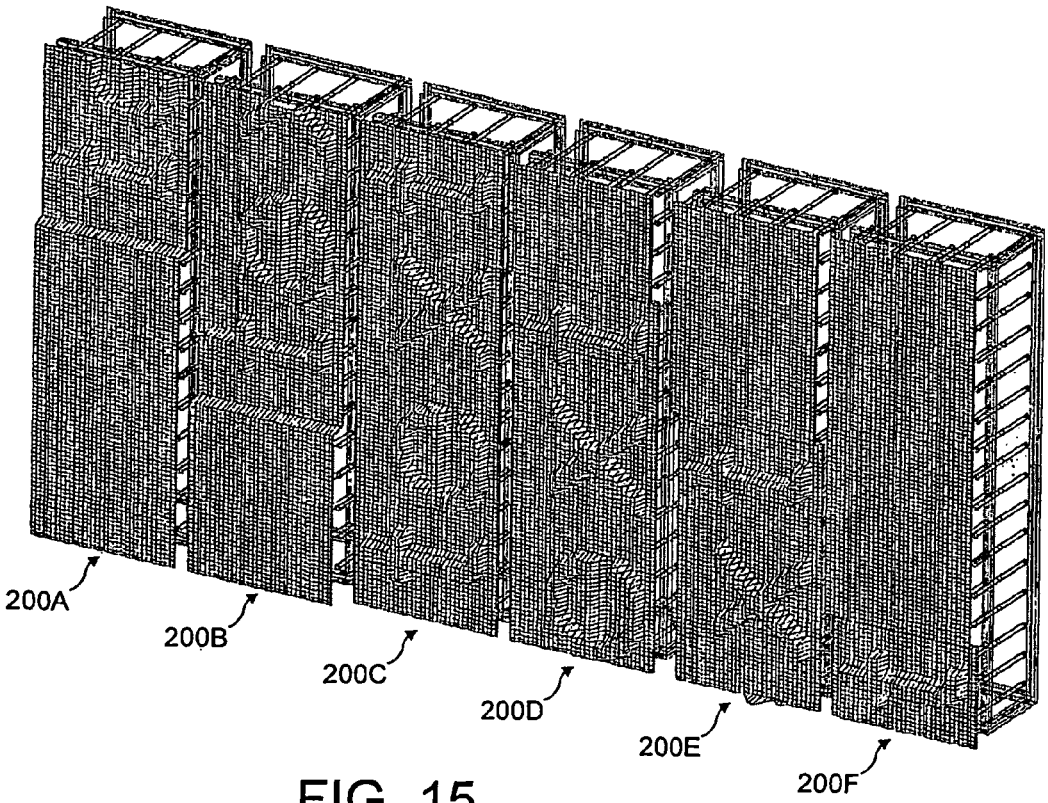
FIG. 15 is an illustration showing how text may be scrolled across the surface of a display system.

FIG. 15 shows how text may be scrolled across the surface of a display screen. It also shows how the mechanical display apparatus may be a series of modules 200A-200E which may be positioned in series. Adjacent edges of adjacent display screens are connected together so that the overall display apparatus may be controlled and function as one device.

In the second prototype, the facets 243 do not overlap, but they could do and the overlapping facet edges would slide over one another as the display screen articulates, say up to the expected 45° surface pitch relative to the flat rest position.

It is envisaged that the throw of the pistons (and thus the extent of forward movement of the display screen from its rest position) will be at least 5 cm, and more preferably at least 10 cm, at least 20 cm, at least 40 cm or at least 60 cm. This is in order to ensure that the surface effect is visible easily from a distance (eg when the display screen is a billboard) with sufficient localized relative articulation between adjacent areas of the screen surface to make the surface effect dramatic and visible.

C.2 Outline Specification of a Closed-Loop System

Integrated Closed Loop System

In an Integrated Closed Loop System, the pistons will have accurate positional control. I would use standard components such as pistons which give accurate movement to 2 mm, or customize a servo-step system to suit the high-speed and relative inaccuracy demanded by the apparatus. In this system the Software will simply tell the piston where to go, and all the complexity of the time-signals being fed to the solenoid valves will be circumvented.

Independent Closed Loop System

Here the actuators will be essentially the same as the Open-Loop System specified above, but where the position of all the pistons is continuously monitored and fed back to the Control System Computer 101. In the current Open-Loop System the valves are opened for a certain length of time that approximates to any of 15 step positions along the piston stroke. Since the only positional control is the time that the valve is opened for, in the Open Loop System the pistons quite quickly work themselves out of position as the errors accumulate, and this means that there is a limited time that the pistons can operate away from base; this in turn limits the range of effects that are possible.

In an Independent Closed Loop System the difference will be that a feedback signal to the Control System Computer 101 will result in a modification that corrects any anomaly in the pistons actual versus ideal position. In other words, the subsequent signal will be increased or decreased to continuously correct any positional error.

Any method may be used to achieve an actual measuring of the piston's position, whether by mechanical, electrical or optical means (such as laser scanning). Evidently such a feed-back system requires that it be synchronized with the output signals to the pistons, and the entire bus system upgraded to suit the increased requirement for information flow.

The invention claimed is:

1. Display apparatus comprising:

a mechanically reconfigurable display surface facing in a forward, display direction; and an array of mechanical actuators positioned behind the display surface and operable to move forwards and backwards to deform the display surface to have configurations which display a dynamic visible 3-dimensional surface effect;

wherein the display surface comprises an array of movable display facets which are flexibly connected together, wherein the connections between the facets define an array of connection nodes and the actuators are connected to the connection nodes, wherein along orthogonal axes of the array of connection nodes the connections to the actuators are at every second connection node, and wherein the connections of the actuators to the connection nodes define a grid of square grid cells with each grid cell having one of the actuators at each corner and connected to eight of the facets.

2. Display apparatus according to claim 1, wherein the actuators have rear ends which are connected to a static support structure behind the display surface and front ends which are flexibly coupled to the display surface.

3. Display apparatus according to claim 2, wherein the rear ends of the actuators are articulated to the support structure.

4. Display apparatus according to claim 1, wherein the facets are generally polygonal.

5. Display apparatus according to claim 4, wherein the facets are generally triangular.

6. Display apparatus according to claim 1, wherein opposed edges of the facets are slightly longitudinally convex to accommodate articulation of the facets.

7. Display apparatus according to claim 1, wherein the facets are rigid relative to the flexible connections between the facets.

8. Display apparatus according to claim 1, wherein the display surface is a display wall.

9. Display system comprising display apparatus according to claim 1 and a control system for controlling the display apparatus wherein the control system comprises a computer means for determining output commands for the actuators to produce the configurations of the display surface and output means for outputting the commands.

10. Display apparatus according to claim 1, wherein the front end of each actuator carries a connection device having flexible legs connected to respective facets.

11. Display apparatus according to claim 10, wherein the flexible legs are positioned side by side, are connected to corners of the respective facets and are arranged to splay apart upon forward movement of the actuator.

12. Display apparatus comprising:

a mechanically reconfigurable display surface facing in a forward, display direction; and an array of mechanical actuators positioned behind the display surface and operable to move forwards and backwards to deform the display surface to have configurations which display a dynamic visible 3-dimensional surface effect;

wherein the display surface comprises an array of movable display facets which are flexibly connected together, wherein the connections between the facets define an array of connection nodes and the actuators are connected to the connection nodes, and wherein the front end of each actuator carries a connection device having flexible legs connected to respective facets.

13. Display apparatus according to claim 12, wherein the flexible legs are positioned side by side, are connected to corners of the respective facets and are arranged to splay apart upon forward movement of the actuator.

14. Display apparatus according to claim 12, wherein the actuators have rear ends which are connected to a static support structure behind the display surface.

15. Display apparatus according to claim 14, wherein the rear ends of the actuators are articulated to the support structure.

16. Display apparatus according to claim 12, wherein the facets are generally polygonal.

17. Display apparatus according to claim 16, wherein the facets are generally triangular.

18. Display apparatus according to claim 12, wherein opposed edges of the facets are slightly longitudinally convex to accommodate articulation of the facets.

19. Display apparatus according to claim 12, wherein the facets are rigid relative to the flexible connections between the facets.

20. Display apparatus according to claim 12, wherein the display surface is a display wall.

21. Display system comprising display apparatus according to claim 12 and a control system for controlling the display apparatus, wherein the control system comprises a computer means for determining output commands for the actuators to produce the configurations of the display surface and output means for outputting the commands.

22. Display apparatus comprising:

a mechanically reconfigurable display surface facing in a forward, display direction; and an array of mechanical actuators positioned behind the display surface and operable to move forwards and backwards to deform the display surface to have configurations which display a dynamic visible 3-dimensional surface effect;

wherein the display surface is a display screen comprising an array of screen elements carried by the ends of the actuators and connected together by and integral with elastic interconnectors biased to pull the screen elements together but extendable in response to actuator actuation to allow the screen elements to move transversely apart; and wherein the display screen is a molded elastic layer of predetermined thickness and having folds extending into the thickness of the layer to allow the screen elements to move apart.

* * * * *